US010650954B2

(12) United States Patent
Lemez et al.

(10) Patent No.: US 10,650,954 B2
(45) Date of Patent: May 12, 2020

(54) LOSSES REDUCTION FOR ELECTRICAL POWER DISTRIBUTION

(71) Applicant: ENERGO GROUP CANADA INC., Calgary (CA)

(72) Inventors: Dragan Lemez, Calgary (CA); Aleksander Lemez, Istocno Sarajevo (BA)

(73) Assignee: ENERGO GROUP CANADA INC., Calgary (CA)

( * ) Notice: Subject to any disclaimer, the term of this patent is extended or adjusted under 35 U.S.C. 154(b) by 32 days.

(21) Appl. No.: 16/333,950

(22) PCT Filed: Sep. 13, 2017

(86) PCT No.: PCT/CA2017/051077

§ 371 (c)(1),
(2) Date: Mar. 15, 2019

(87) PCT Pub. No.: WO2018/049520

PCT Pub. Date: Mar. 22, 2018

(65) Prior Publication Data

US 2019/0214178 A1 Jul. 11, 2019

Related U.S. Application Data

(60) Provisional application No. 62/395,539, filed on Sep. 16, 2016.

(51) Int. Cl.
*H01F 27/24* (2006.01)
*H01F 27/08* (2006.01)
(Continued)

(52) U.S. Cl.
CPC ..... *H01F 27/24* (2013.01); *H01F 27/025* (2013.01); *H01F 27/085* (2013.01); *H01F 27/20* (2013.01);
(Continued)

(58) Field of Classification Search
CPC ..... H01F 27/00–36
(Continued)

(56) References Cited

U.S. PATENT DOCUMENTS 5,396,165 A 3/1995 Hwang et al.
5,604,385 A 2/1997 David
(Continued)

FOREIGN PATENT DOCUMENTS

WO 99/49481 A1 9/1999

OTHER PUBLICATIONS

International Search Report and Written Opinion, dated Dec. 5, 2017 for PCT/CA2017/051077, 8 pages.
(Continued)

*Primary Examiner* — Tuyen T Nguyen
(74) *Attorney, Agent, or Firm* — Seed Intellectual Property Law Group LLP

(57) ABSTRACT

A transformer apparatus that may be applied as a distribution circuit adaptor (DCA) inserted into a branch supply circuit to reduce losses in a power distribution network. More particularly, implementations of the present disclosure provide a high-efficiency 2-phase dry type transformer apparatus with a removable core, as well as integrated instrumentation and thermal self-management.

28 Claims, 10 Drawing Sheets

(51) Int. Cl.

| | |
|---|---|
| ***H01F 27/26*** | (2006.01) |
| ***H01F 27/30*** | (2006.01) |
| ***H01F 27/02*** | (2006.01) |
| ***H01F 27/20*** | (2006.01) |
| ***H01F 27/29*** | (2006.01) |
| ***H01F 38/26*** | (2006.01) |
| ***H01F 38/30*** | (2006.01) |
| ***H01F 41/02*** | (2006.01) |
| ***H01F 41/04*** | (2006.01) |
| *H01F 27/245* | (2006.01) |
| *H01F 27/40* | (2006.01) |

(52) U.S. Cl.
CPC ..... *H01F 27/263* (2013.01); *H01F 27/29* (2013.01); *H01F 27/306* (2013.01); *H01F 38/26* (2013.01); *H01F 38/30* (2013.01); *H01F 41/0206* (2013.01); *H01F 41/04* (2013.01); *H01F 27/245* (2013.01); *H01F 27/40* (2013.01); *H01F 27/402* (2013.01)

(58) Field of Classification Search
USPC ..... 336/65, 83, 90, 92, 96, 192, 196, 198, 336/210–215, 233–234
See application file for complete search history.

(56) References Cited

U.S. PATENT DOCUMENTS

| | | | | |
|---|---|---|---|---|
| 7,242,110 | B2 | 7/2007 | Matsumoto et al. | |
| 8,188,823 | B2 | 5/2012 | Le et al. | |
| 10,361,024 | B2 * | 7/2019 | Hanov ..... | H01F 27/24 |
| 2011/0156851 | A1 | 6/2011 | Honna | |
| 2011/0248808 | A1 * | 10/2011 | Singh ..... | H01F 27/23 336/5 |
| 2014/0146427 | A1 | 5/2014 | Huang et al. | |
| 2015/0091545 | A1 | 4/2015 | Kussyk et al. | |

OTHER PUBLICATIONS

International Search Report, dated Apr. 5, 2017, for International Application No. PCT/CA2016/051553, 3 pages.
Written Opinion of the International Searching Authority, dated Apr. 5, 2017, for PCT/CA2016/051553, 5 pages.
U.S. Appl. No. 15/559,344, filed Sep. 18, 2017, Method and System for Reducing Losses During Electrical Power Distribution.

* cited by examiner

LOSSES REDUCTION FOR ELECTRICAL POWER DISTRIBUTION

BACKGROUND

Technical Field

The present disclosure generally relates to a novel implementation of a distribution circuit adaptor (DCA) in the form of a 2-phase transformer that may be installed in a power distribution network to optimally reduce losses inherent in traditional use of local soil or "earth" as the "ground" (or neutral conductors) as a return path to close a supply circuit, while also reducing voltage instability.

Description of the Related Art

Transformers are well-known static or stationary electrical machines. With no intentionally moving parts, their electrical losses occur through imperfections in the core and the coils the result of which is to waste input energy. Traditionally, these machines are 93% to 97% efficient using modern techniques and materials.

Energy is transferred through a transformer. Some of the energy delivered to a transformer is "consumed" during this transfer process, in the sense that it is not delivered to the output terminals and available for powering loads. Minimizing such losses is critical to network operators who cannot resell energy that is consumed by their own equipment. Losses present in all transformers are typically the result of five electro-physical effects: (1) Hysteresis of the core material; (2) Eddy currents flowing in the core material; (3) ohmic heating of each of the coils; (4) Inductive reactance between the coil sets; and (5) Stray fluxes induced in other parts of the transformer structure.

Hysteresis and eddy current losses are both related to the core material so are sometimes collectively known as iron losses. They are not substantively affected by current flow through the load such that they occur when the transformer is connected to a source on its primary side even if there is nothing connected to its secondary coils. Hysteresis losses occur due to the electrical energy consumed by the magnetomotive forces necessary to reverse spontaneous magnetism (residual misalignment of dipoles) in ferromagnetic materials because alternating current sources are used to generate the magnetic field that flows through the core of a transformer. Eddy current losses occur when the desired magnetic field created by the electrical source intentionally applied to the primary coils induces swirling (i.e. eddies) parasitic currents in the core itself (i.e. not the secondary coil) and those currents in turn induce undesired magnetic fields that oppose the desired fields.

Disadvantageously, selecting a core material that suffers spontaneous magnetism and is not applied to minimize eddy currents will result in substantial "iron loss" that reduces transformer efficiency.

Similarly, the selection of coil material of lower purity and formed in a cross section that fails to appropriately consider conductivity at operational temperature can result in excessive "copper loss" due to ohmic heating of the coils converting electrical energy into heat. This heat in turn increases the resistivity of that conductor aggravating the very loss causing it, until the insulation fails. These heating losses occur in both the primary and secondary coils, such that minimizing resistivity at operational current and thermal conditions influences both efficiency and component longevity.

The configuration of the coil sets relative to one another and the precision with which the selected configuration is implemented also affects transformer performance. A given electrical design will be based on a structural design calling for a specified "air" (or other insulative) gap between coils comprised of a specified conductor material, shape and insulation thickness. Imperfections in the conductive material and fabrication errors resulting in an uneven gap between the coils will influence performance since the inductive reactance of a transformer is determined by this air gap, along with the number of turns in the coil as well as the physical dimensions of the coil. Failing to sufficiently quality control such factors will result in limiting short circuit current capacity and the ability of the transformer to survive fault events.

The mechanical structure of a transformer typically includes rigid elements necessary to support the weight of the (typically heavy) electrically operational components. Inappropriate choices in the selection of such rigid elements (including fasteners and mounting means) can lead to unexpected stray fluxes being induced and cause the final assembly to function outside its design efficiency. This is true of both the electrical and thermal capacity of a transformer and so a necessary consideration that can be overlooked prior to installation. Importantly, despite the effort that is invested in fabricating transformers from appropriate material, when failure of any coil occurs the core is also effectively lost and either disposed or subject to complete recycling since is it immersed in resin with the coils that are wrapped around it. Disadvantageously, the expensive core component is difficult to reuse.

Instrument transformers are known high accuracy electrical devices used to isolate or transform voltage or current levels. The most common usage of instrument transformers is to operate instruments or metering from high voltage or high current circuits, safely isolating secondary control circuitry from the high voltages or currents. The primary winding of the transformer is connected to the high voltage or high current circuit, and the meter or relay is connected to the secondary circuit. Instrument transformers may also be used as an isolation transformer so that secondary quantities may be used in phase shifting without affecting other primary connected devices. Typically these devices are used in a stand-alone configuration and connected to power transformers as needed.

BRIEF SUMMARY

In order to overcome at least some of the disadvantages of the currently available dry transformers, according to the present disclosure, in one of its broad implementations, there is provided a novel transformer apparatus that does contemplate such operational considerations. In order to achieve greater than 99 percent efficiency of the transformers of the present disclosure, the core material-quality and fabrication-precision are advantageously designed. The higher expense inherent in such a core warrants the novel means of salvaging it for reuse. Synergistically, by designing a transformer from which the core could be removed, the means for better cooling the transformer's coils has presented itself. And, to capture all the benefits of this novel configuration of core and coils, the opportunity to manage the temperature of this transformer also arose.

Rather than following standard practice in which the core is selected from an "off the shelf" design, here highest quality materials are applied to minimize hysteresis and then treated and fabricated to minimize eddy currents. Various new compositions are being reviewed and tested to coat the cut sheets of Hypersil® in the expectation of thereby further suppressing eddy currents and the waste of energy associated with them. These coated, flux-carrying components are then assembled to facilitate removal of an element comprising 40% of the cost and 70% of the weight of the transformer.

Hand in hand with the removable core, two annular passageways result between the resin encapsulated coil banks and the core legs guiding the magnetic flux through the concentric coil sets comprising those banks. These resulting passageways create an opportunity to moderate the temperature of all elements that comprise the novel transformer of this present disclosure. Accordingly, there is a temperature management subsystem (TMS) processing thermal data collected from the transformer and the ambient conditions in which the transformer is installed. This TMS may reference historical data and forecasts based on which it operates forced air cooling means and airway vents as needed. The same programming also takes into account electrical loading profiles and projections respecting the amount of heat the transformer will be generating and the need to dissipate or store that waste energy in order to maintain the transformer coil banks at or near their optimal operating condition. It is the integrated instrumentation capability of this present disclosure that permits the TMS to collect the electrical loading data necessary to make such projections and implement its own thermal management.

A transformer apparatus may be summarized as including an encasement having first and second passages therein spaced apart from each other, each of the first and second passages extends between a top and a bottom of the encasement; first and second coil banks disposed within the encasement, each of the first and second coil banks surrounds a respective one of the first and second passages, each of the first and second coil banks includes at least one coil; a core including a first core leg selectively positionable within the first passage of the encasement, the first core leg includes an upper end and a lower end opposite the upper end; a second core leg selectively positionable within the second passage of the encasement, the second core leg includes an upper end and a lower end opposite the upper end; a top core bridge selectively coupleable to each of the respective upper ends of the first and second core legs; and a bottom core bridge selectively coupleable to each of the respective lower ends of the first and second core legs. The first coil bank may include a first primary coil and a first secondary coil, and the second coil bank may include a second primary coil and a second secondary coil. The first secondary coil may be disposed concentrically inside the first primary coil, and the second secondary coil may be disposed concentrically inside the second primary coil. The first and second primary coils may be electrically coupled in series, and the first and second secondary coils may be electrically coupled in parallel.

The transformer apparatus may further include a first screen which at least partially surrounds the first coil bank; and a second screen which at least partially surrounds the second coil bank. Each of the first screen and the second screen may include graphite. The encasement may be formed of a resin. The encasement may be formed of a resin mixed with a quartz filler. Each of the first core leg, second core leg, top core bridge and bottom core bridge may include a stack of a plurality of sheets of ferromagnetic material. Each of the first core leg, second core leg, top core bridge and bottom core bridge may include a stack of a plurality of sheets of laminated grain-oriented silicon steel.

The transformer apparatus may further include an upper clamp which selectively couples the top core bridge to each of the respective upper ends of the first and second core legs; and a lower clamp which selectively couples the top core bridge to each of the respective upper ends of the first and second core legs.

The transformer apparatus may further include a voltage instrumentation transformer including a first coil disposed within the first coil bank; and a second coil disposed within the second coil bank. The first coil bank may include a first primary coil and a first secondary coil, the second coil bank may include a second primary coil and a second secondary coil, the first coil of the voltage instrumentation transformer may be disposed concentrically outside the first secondary coil, and the second coil of the voltage instrumentation transformer may be disposed concentrically outside the second secondary coil. Respective first terminals of each of the first coil of the voltage instrumentation transformer, the second coil of the voltage instrumentation transformer, the first secondary coil and the second secondary coil may be electrically coupled together.

The transformer apparatus may further include a current instrumentation transformer including a current instrumentation transformer core; a first coil surrounding at least a portion of the current instrumentation transformer core, the first coil electrically coupled in series with the at least one coil of the first coil bank; and a second coil surrounding at least a portion of the current instrumentation transformer core. The first coil bank may include a first primary coil and a first secondary coil, the second coil bank may include a second primary coil and a second secondary coil, and the first coil of the current instrument transformer may be electrically coupled in series with the first primary coil and the second primary coil.

The transformer apparatus may further include a voltage instrumentation transformer electrically coupled in parallel with at least one coil of the transformer apparatus; and a current instrumentation transformer electrically coupled in series with at least one of coil of the transformer apparatus. At least one of the voltage instrumentation transformer and the current instrumentation transformer may provide power to at least one of a metering device, a recording device or a communication device. At least one of the voltage instrumentation transformer and the current instrumentation transformer may provide monitoring of at least one of voltage, current, energy, peak load or load profiles.

The transformer apparatus may further include a temperature management subsystem which in operation selectively controls air flow through the first and second passages of the encasement.

The transformer apparatus may further include at least one instrumentation transformer electrically coupled to at least one coil of the transformer apparatus and which provides operational parameter data relating to at least one operational parameter of the transformer apparatus to the temperature management subsystem, wherein the temperature management subsystem selectively controls air flow through the first and second passages of the encasement based at least in part on the received operational parameter data. The temperature management subsystem may include at least one fan positioned to cause air to flow upward through at least one of the first and second passages of the encasement. The first coil bank may include a first primary coil and a first secondary coil nested concentrically inside the first primary coil, and the second coil bank may include a second primary coil and a second secondary coil nested concentrically inside the second primary coil, the first and second primary coils may be electrically coupled in series, and the first and second secondary coils may be electrically coupled in parallel.

The transformer apparatus may further include a voltage instrumentation transformer including a first coil nested concentrically outside the first secondary coil; and a second coil nested concentrically outside the second secondary coil; and a current instrumentation transformer including a current instrumentation transformer core; a first coil surrounding at least a portion of the current instrumentation transformer core, the first coil electrically coupled in series with the first primary coil and the second primary coil; and a second coil surrounding at least a portion of the current instrumentation transformer core. The first primary coil may be electrically coupleable to a first phase terminal of a three-phase power source, the second primary coil may be electrically coupleable a second phase terminal of the three-phase power source and each of the first and second secondary coils may be electrically coupleable to a load to provide single phase power to the load. The first coil bank may include a primary coil of a single phase step down transformer and the second coil bank may include a secondary coil of a single phase step down transformer. Each of the first and second passages of the encasement may be at least partially open at the top and bottom of the encasement to provide self-cooling of the transformer apparatus via the chimney effect. Each of the first and second passages may have a respective wall which may be cylindrical in shape to reduce or prevent stray flux of the transformer apparatus.

A method of providing a transformer apparatus may be summarized as including providing first and second coil banks spaced apart from each other, each of the first and second coil banks includes at least one coil; providing at least one instrumentation transformer; casting a first encasement around the first and second coil banks and the at least one instrument transformer, wherein the first encasement includes first and second passages therein spaced apart from each other, each of the first and second passages extends between a top and a bottom of the first encasement within a respective one of the first and second coil banks; positioning a first core leg within the first passage of the first encasement, the first core leg includes an upper end and a lower end opposite the upper end; positioning a second core leg within the second passage of the first encasement, the second core leg includes an upper end and a lower end opposite the upper end; coupling a top core bridge to each of the respective upper ends of the first and second core legs; and coupling a bottom core bridge to each of the respective lower ends of the first and second core legs. Providing first and second coil banks may include providing a first coil bank may include a first primary coil and a first secondary coil, and providing a second coil bank may include a second primary coil and a second secondary coil. Providing first and second coil banks may include positioning a first secondary coil concentrically inside the first primary coil, and positioning the second secondary coil concentrically inside the second primary coil. Providing the first and second coil banks may include electrically coupling the first and second primary coils in series, and electrically coupling the first and second secondary coils in parallel. Casting a first encasement may include casting a first encasement formed of a resin mixed with a filler.

The method may further include coupling the at least one instrument transformer to at least one of a metering device, a recording device or a communication device.

The method may further include selectively controlling, via a temperature management subsystem, air flow through the first and second passages of the first encasement.

The method may further include receiving operational parameter data relating to at least one operational parameter of the transformer apparatus; and selectively controlling air flow through the first and second passages of the first encasement based at least in part on the received operational parameter data.

The first coil bank may include a first primary coil and a first secondary coil nested concentrically inside the first primary coil, and the second coil bank may include a second primary coil and a second secondary coil nested concentrically inside the second primary coil, the first and second primary coils may be electrically coupled in series, and the first and second secondary coils may be electrically coupled in parallel, and the method may further include electrically coupling the first primary coil to a first phase terminal of a three-phase power source; electrically coupling the second primary coil a second phase terminal of the three-phase power source; and electrically coupling each of the first and second secondary coils to a load to provide single phase power to the load.

The method may further include at least one of: decoupling the top core bridge from each of the respective upper ends of the first and second core legs; or decoupling the bottom core bridge from each of the respective lower ends of the first and second core legs; removing the first core leg from within the first passage of the first encasement; and removing the second core leg from within the second passage of the first encasement.

The method may further include providing a second encasement, different from the first encasement, the second encasement having first and second passages therein spaced apart from each other, each of the first and second passages extends between a top and a bottom of the second encasement, the second encasement including first and second coil banks disposed therein, each of the first and second coil banks surrounds a respective one of the first and second passages, each of the first and second coil banks includes at least one coil; positioning the first core leg within the first passage of the second encasement; positioning the second core leg within the second passage of the second encasement; at least one of: coupling the top core bridge to each of the respective upper ends of the first and second core legs; or coupling the bottom core bridge to each of the respective lower ends of the first and second core legs.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with computer systems, server computers, and/or communications networks have not been shown or described in detail to avoid unnecessarily obscuring descriptions of the implementations.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the implementations.

Figure 1:
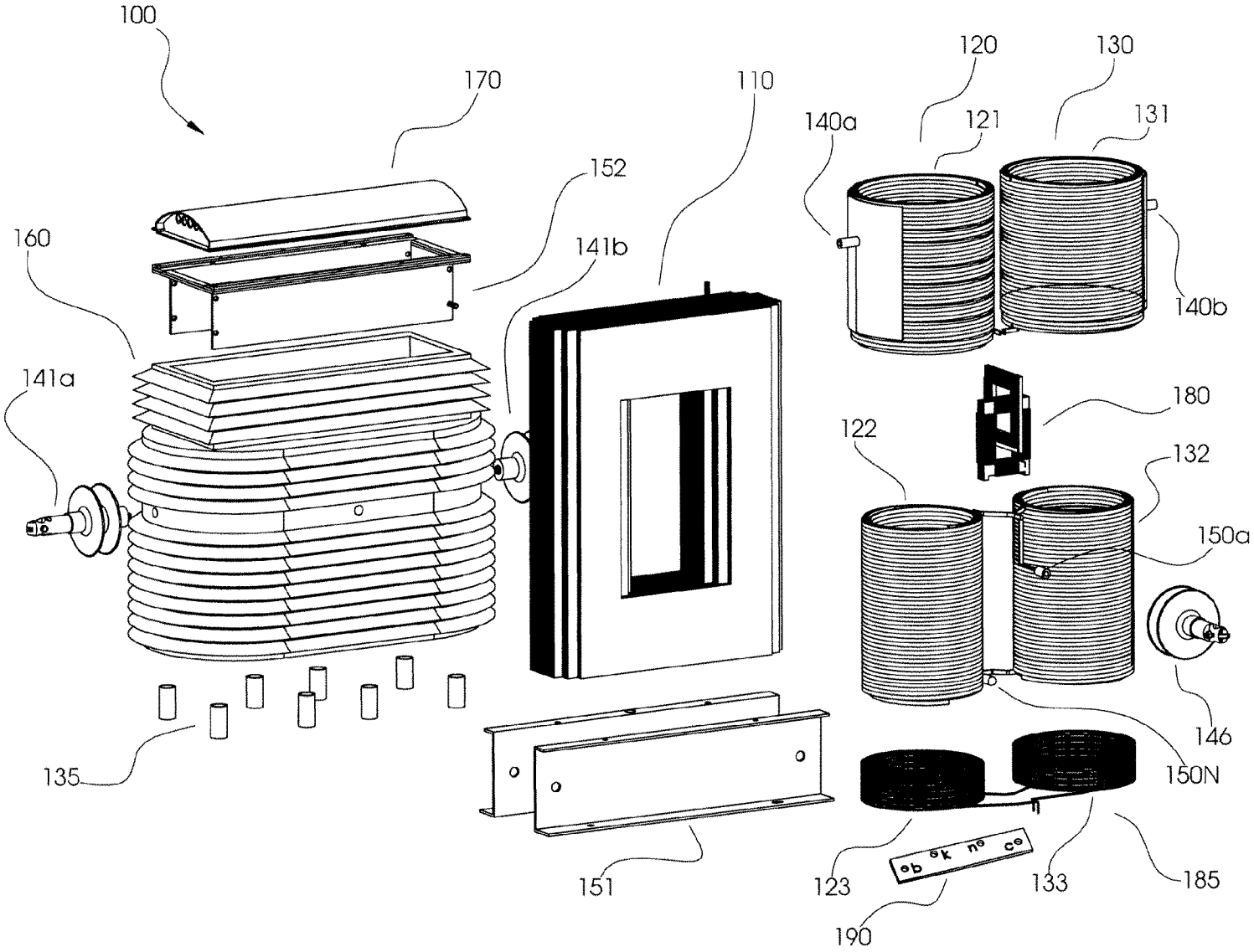
FIG. 1 is an exploded view of an implementation of the apparatus of the present disclosure in which all of the operational elements (some shown as subsystems) are visible. The means of mechanically fastening these elements are not shown and the subsystems and accessories are illustrated in greater detail in separate figures.

Referring now to FIG. 1, there is shown an exploded view of a dry transformer 100 constructed in accordance with an implementation of the present disclosure. Transformer 100 is comprised generally of: a core 110, a first bank of nested (i.e. secondary inside primary) concentrically positioned coils 120, a second bank of concentrically positioned coils 130, coil position setting insulators or supports 135, a pair of primary (high voltage) input terminals 140*a* and 140*b* together with their associated network connectors 141*a* and 141*b*, a pair of secondary output terminals 150*a* and 150N together with their associated network connectors 145 (not visible in this view) and 146, a pair (lower and upper) of core clamps 151 and 152, a cast encasement 160, a non-magnetic weather shield and upper ventilation subassembly 170, an integrated instrumentation coil subassembly comprised of current transformer 180 and voltage transformer 185.

FIG. 1 specifically illustrates a 2-phase transformer however, it is to be understood that the present disclosure is not limited to 2-phase construction. As a non-limiting example, a transformer assembled in accordance with the design of this present disclosure may accommodate input voltages up to 72 kV, with a power rating up to 2,500 kVA. Coil bank 120 is comprised of primary coil 121 concentrically inside which is secondary coil 122, over the base of which is instrumentation coil 123, electrically insulated from secondary coil 122. Similarly, coil bank 130 is comprised of primary coil 131 concentrically inside which is secondary coil 132, over the base of which is instrumentation coil 133. Instrumentation coils 123 and 133 may be connected in parallel to form voltage transformer (VT) 185. Terminal Board 190 may be molded into a recessed space in the base of apparatus 100 where the terminal board provides access to all of the integrated instrumentation (CT 180 and VT 185) data recording and peripheral power supply.

Not shown in FIG. 1 are the electrical insulations: (e.g. Staklolit®) isolating the copper coil sets, (e.g. glass fabric woven sheets) isolating layers of windings by wrapping them, (e.g. Trivolton®) isolation sheets separating coils banks 120 and 130 from core 110, a "graphite screen"

(around primary coils 121 and 131) preventing the electrical field of the coils from passing outside cast encasement 160, and various electrical and thermal covering materials used to protect connections between said coils. However, by using thermally-conductive quartz impregnated but electrically non-conductive Araldite® to mould cast encasement 160, in combination with non-magnetic stainless steel hardware and faraday cage forming graphite screens to prevent mmf and emf being collaterally induced, the design of the present disclosure avoids energy wasting parasitic eddy currents arising outside its core as well.

It is to be understood that different (electrical) capacity implementations of the apparatus of the present disclosure will require different quantities and sizes of each of the operational (e.g. 9×3.5 mm profiled copper conduit, and poly coated copper wire filaments), connective and insulative materials identified above. A person of skill in the art would understand that while core 110 is comprised of stacks of magnetic Hypersil®, other components such as the core clamps, mounts, fasteners, and spacers will be suitably fabricated from stainless steel, brass, tin, porcelain, rubber, etc. Cast encasement 160 is, according to one implementation, fabricated from any suitable resin such as Araldite® mixed with a filler, such as quartz flour, as well as suitable hardeners, accelerators and color elements.

As may be seen in the implementation of FIG. 1, core 110 has a substantially rectangular shape with a central opening and is composed of a ferromagnetic material, such as Hypersil®. Core 110 may be comprised of laminated sheets or strips of steel (in some cases as simple as grain-oriented silicon steel). The low voltage winding (see FIG. 4) may comprise a length of wire, such as copper wire or strips, wrapped around a mandrel (in place of core 110) during fabrication to form a plurality of turns that are eventually disposed around the circumference of, but physically separate from one leg (see FIG. 2) of core 110. End portions of said low voltage winding are secured to transformer leads, which are connected to the terminal board 190 mounted in a recess at the base of encasement 160 to which recess there is an access panel (see FIG. 6B).

Figure 2:
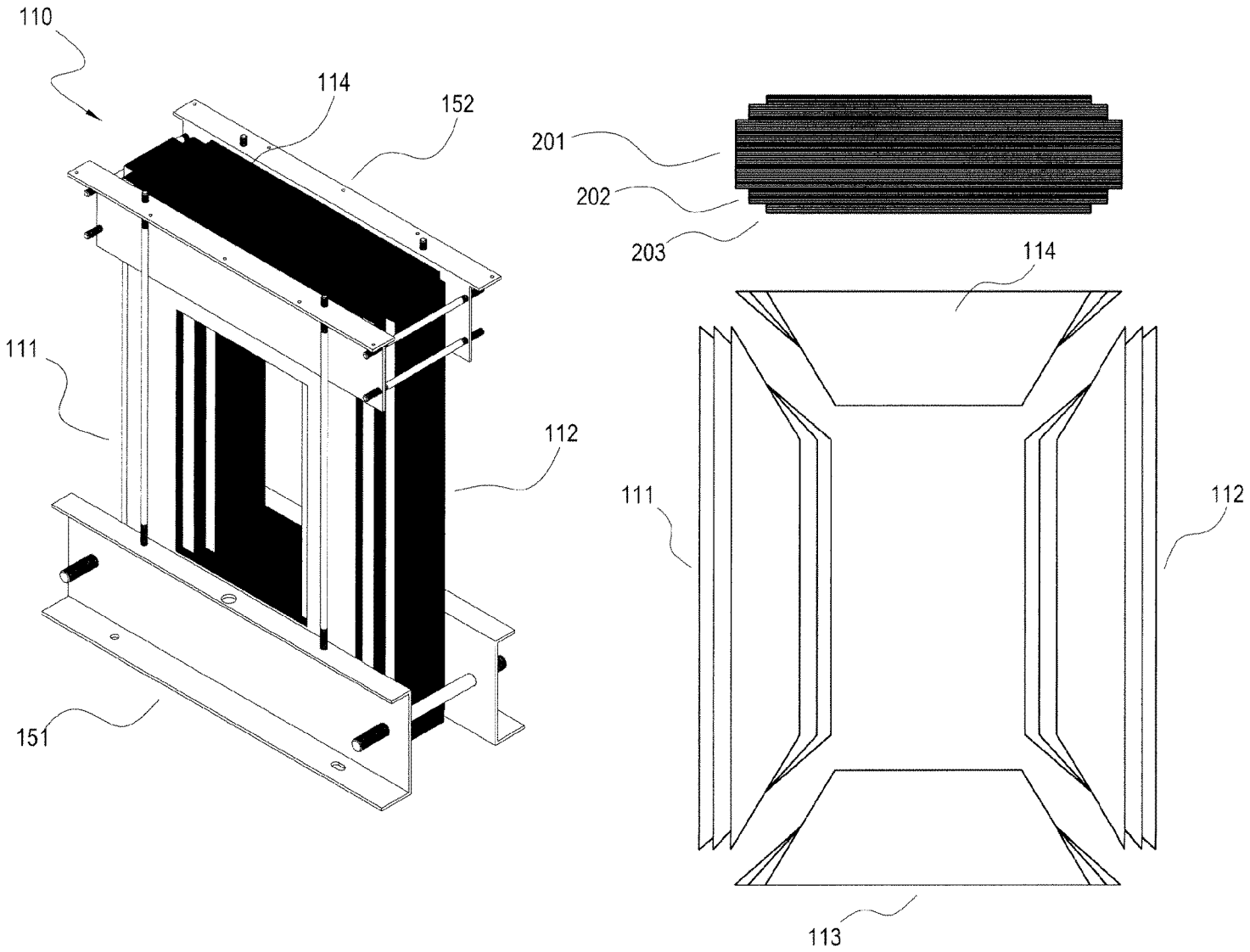
FIG. 2 is an isometric view of the magnetic core subassembly, including one implementation of the mechanism for clamping the layered (e.g. Hypersil®) magnetic plates in position. Adjacent the isometric view are a top view and a side view of the core, in which the saw tooth pattern (formed by the three different widths of magnetic plates are sandwiched together) and different layers of the core are visible.

Referring now to FIG. 2, there is shown an isometric view of core 110 fully clamped together. Lower clamp assembly 151 and upper clamp assembly 152 are visible in their operational positions with both vertical and horizontal fasteners illustrated but not labelled. It is to be understood that any suitable (non-magnetic) means of clamping core legs 111 and 112 in position relative to core bridges 113 and 114, is acceptable. Adjacent the isometric view of core 110 is an exploded view in which a sample of the individual sheets comprising core legs 111 and 112 and core bridges 113 and 114 are visible. Above this view is a top view of core 110 looking down core bridge 114 in which three layers (201, 202, 203) of different length sheets are visible. The dimensions and number of each of the sheets required to form core 110 is understood to depend on the capacity of the transformer 100 of which these sheets are parts. As the thickness of each sheet decreases the number of sheets required increases, but the ability of eddy currents to initiate and circulate decreases. These sheets will be coated with any suitable insulative material before assembly.

Core 110 is comprised of any ferromagnetic substance (e.g. Hypersil®) suitably shaped to permit the relative positioning of coil banks 120 and 130 while focussing their respective electromagnetic fields through the annulus of their concentric assembly. According to one implementation of the present disclosure, core 110 is comprised of a plurality of thin iron plates coated with poorly conducting varnish to resist the generation of eddy currents. The plates that comprise this implementation are held together by suitable mechanical fastening means between their lower and upper clamps. For ease of transformer assembly, the laminated plates comprising the rectilinear core as shown are comprised of two (typically) vertical core legs 111 and 112, which vertical elements are mechanically and electromagnetically connected by two horizontal core bridges 113 and 114. Any suitable fastening means maintains these elements in position.

Advantageously, the present design has a removable core that makes a temperature management subsystem (including coil-cooling as needed) very efficient. To a limited extent apparatus 100 is also field serviceable for ease of replacement of components (e.g. 141*a*, 141*b*, and 146) that commonly fail after lengthy exposure to the environment and non-catastrophic events. However, even for lightning strikes or other events that lead to catastrophic surges of current through its coil banks, apparatus 100 is rapidly and cost effectively back in service after moving its high-efficiency core into a new casting encasing a fresh coil bank set to which many of the surviving peripheral components can also be re-attached and placed back in service. Operators in remote rural areas will experience a major cost savings by investing in backup coil castings for inventory, avoiding the cost of hot-shot shipping the heavy and relatively expensive core element that will rarely be damaged in any event.

The related system, previously described in U.S. provisional application No. 62/274,948, into which the apparatus of the present disclosure may be applied also contemplates rapid maintenance and repair service and includes isolation means to temporarily restore pre-install conditions getting the damaged network branch back online while apparatus 100 is removed and then repaired in local facilities.

Figure 3:
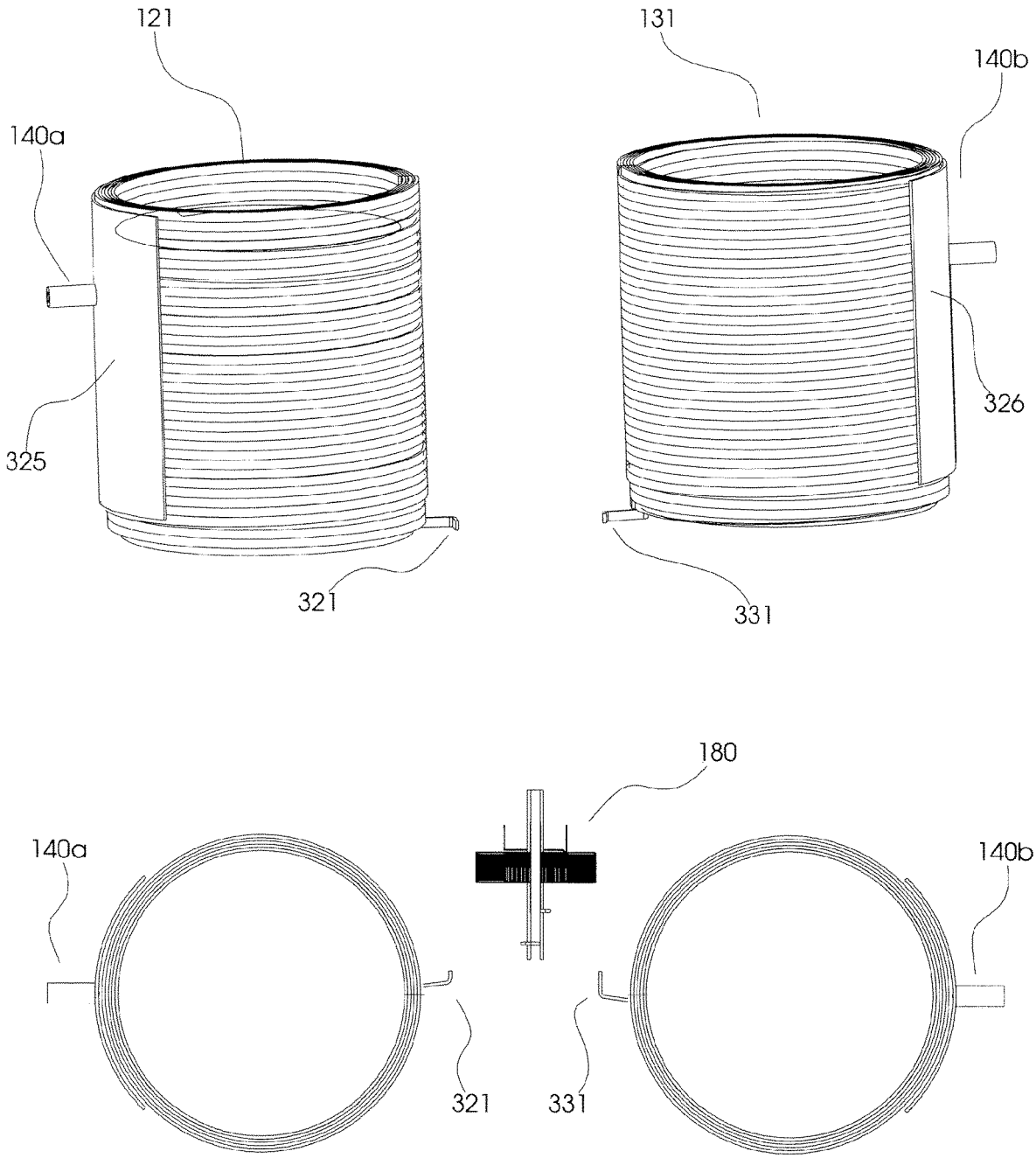
FIG. 3 is an isometric view of the input primary coil set and its connectors before these coils have been wrapped with the graphite screen that later forms a Faraday cage around each coil bank. As shown, the coil shields and end points are visible, but their relative size and position is not to scale. Adjacent the isometric illustration is a top view of the same coil set in which the number of layers is visible as well as a current transformer (CT) shown in detail in FIG. 5.

Referring now to FIG. 3, there is shown the pair of primary coils 121 and 131 formed as spiral cylinders. These primary windings or coils have a larger diameter than the corresponding secondary windings (see FIG. 4) that may be concentrically nested inside them. The annular air gap (resulting upon nesting) design parameter is typically determined by the power transfer and thermal requirements set by the specified installation's requirements. For example, the inner diameter of primary coil 121 may be 20 mm larger than the outer diameter of secondary coil 122. In this example an annulus of 10 mm would remain between these coils after secondary coil 122 was installed concentrically inside primary coil 121. On the exterior of coil 121 there is a non-magnetic (e.g. stainless steel) screen 325 over which a conductor (not shown) connects the last winding of that coil to the primary terminal 140*a* (e.g. a suitable terminal mechanically held in position by screen 325) and in turn to network connector 141*a*. As shown, primary terminal 140*a* comprises a connector that has a threaded bore formed therein, but this could alternately be comprised by an exteriorly threaded post or any other (e.g. press fit) suitable means of mechanically connecting apparatus 100 to the supply network's primary conductor(s). According to one implementation of coil bank 120, instrumentation coil 123 (see FIGS. 6A and 6B) is also installed concentrically inside primary coil 121, disposed at a lower end of secondary coil 122 (see FIGS. 6 and 7) such that instrumentation coil 123 is positioned closer to terminal board 190 that provides electrical access to the integrated instrumentation of apparatus 100 from its undercarriage. Terminal board 190 is visible in FIGS. 1, 6 and 6*a* and installed into a "secondary box" recessed into the base of transformer apparatus 100, where it is protected. Similarly, the interior diameter of primary coil 131 will be larger than the exterior diameter of secondary coil 132. And, shield 326 holds primary terminal 140*b* in position for network connector 141*b* to be electrically connected to a second of the supply network's 3 primary conductors.

Accordingly, primary terminals 140*a* and 140*b* are electrically connected to any one 2-phase pair of the three available 2-phase pairs of the 3-phase supply network into which apparatus 100 is installed.

At the opposing end of spiral primary coil 121 is connector 321, such that the suitably insulated conductor used to form coil 121 comprises a helical inductive electrical circuit between 140*a* and 321.

At the opposing end of spiral primary coil 131 is connector 331, such that the suitably insulated conductor used to form coil 131 comprises a helical inductive electrical circuit between 140*b* and 331.

Since they are supplied by a 3-phase power distribution network, input terminals 140*a* and 140*b* will always be 120 degrees out of phase. Accordingly, apart from any lag induced respecting their EM fields due to differences in the current flow (arising from any loading imbalance) as between primary coils 121 and 131, so too . . . connectors 321 and 331 will always be 120 degrees out of phase.

Following through from FIG. 1 where Current Transformer (CT) 180 is first visible, in FIG. 3 CT 180 is shown between coils 121 and 131. As will be more clearly visible in FIGS. 5 and 7, CT 180 is electrically connected to coils 121 and 131 in series with them, through connectors 321 and 331.

Figure 4:
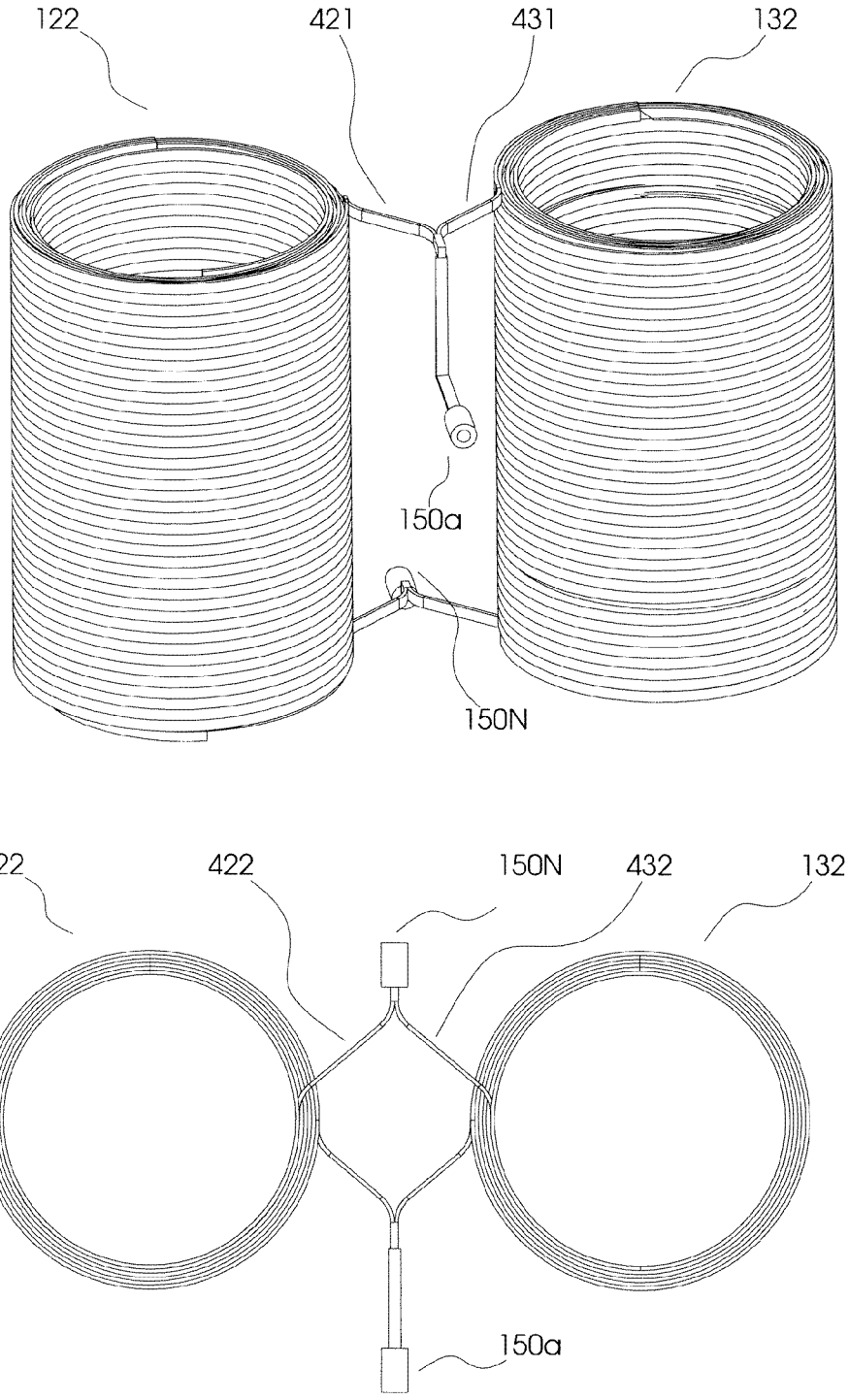
FIG. 4 is an isometric view of the output secondary coil set and its connectors before these coils have been inserted inside the primary coils. As shown, the coil end points (comprising the electrical circuit they result in) are visible, but their relative position is not to scale. Adjacent the isometric illustration is a top view of the same coil set in which the number of layers is visible.

Referring now to FIG. 4, there is shown the pair of secondary coils 122 and 132 formed as spiral cylinders, which will be nested inside primary coils 121 and 131 before any of the 4 of them are installed in a fabrication mold to be immersed in a resin such as Araldite®. As was previously visible in FIG. 1, secondary coils 122 and 132 are connected in parallel. At its first end coil 122 terminates at coil end 421. Similarly, at its first end coil 132 terminates at coil end 431. Coil ends 421 and 431 are electrically connected to form secondary output 150*a* comprising a connector having a threaded bore formed therein for mechanically securing network connector 146.

At the opposing end of spiral secondary coil 122 is coil end 422, such that the suitably insulated conductor used to form coil 122 comprises a helical inductive electrical circuit between 421 and 422.

Similarly, at the opposing end of secondary coil 132 is coil end 432, such that the suitably insulated conductor used to form coil 132 comprises a helical inductive electrical circuit between 431 and 432.

The described parallel connection of secondary coils 122 and 132, results in their opposing ends joining to terminate at what is being referred to as "Neutral". This designation is somewhat arbitrary since the input to apparatus 100 is based on "alternating current". Nevertheless, the opposing end of coil 122 (i.e., coil end 422) terminates at connector 150N which is electrically common to the opposing end of coil 132 (i.e. coil end 432) terminating at the same location "N" (better seen in FIG. 6*a*) where the instrumentation coils 123 and 133 also terminate. Conveniently, whenever safety code requires the output of a transformer to connect to local "ground", this is where apparatus 100 would be grounded. Operationally however, according to an implementation of the system described in U.S. provisional application No. 62/274,948, into which the apparatus of the present disclosure may be applied, apparatus 100 is designed to use a floating neutral such that there is no operational need to ground connector 150N. When apparatus 100 is applied as the DCA of said previous system application, the apparatus acts to adapt a 3-phase source to 1-phase loads.

In summary, 2-phase transformer apparatus 100 accepts input energy from two of the three phases of a 3-phase source (i.e. one 2-phase pair the conductors of which are only 120 degrees out of phase) and converts it to a 1-phase output, supplying the same power using lower input current flow.

Advantageously, as compared to traditional 3-phase sources supplying 1-phase SDTs that each tap only one of the available 3-phase source conductors, then ground the other primary lead of the SDT so as to commonly use an earthen ground for the return path to close that circuit, instead the 2-phase apparatus 100 of at least some implementations of the present disclosure provides an ungrounded pair of secondary output terminals 150*a* and 150N as the (relatively) high voltage input to the primary coil of the 1-phase SDT the secondary of which supplies the low (120/240 Vac) voltage loads of the branch in which apparatus 100 is installed.

Whereas apparatus 100's primary connection is the well-known "Delta" (across 1 of the 3 available 2-phase pairs from a 3-phase source) connection to a 3-phase supply, according to the present disclosure, apparatus 100's secondary operational connection is "Ye" (i.e. "star"/"floating neutral") to supply the primary of a single phase (SDT) load, which permits alternating source energy to flow more smoothly (due to relatively lower resistivity in the "return" circuit) between the network's distant originating substation—along a single (medium voltage) conductor pair, then through apparatus 100 acting as a 2-phase adaptor, then along the second (medium voltage) conductor pair of that branch circuit, to the input terminals of the subject SDT stepping down network power from medium voltage to low voltage for delivery to local loads. At this point, the distance from the SDT to the loading panels is relatively short, such that the instability introduced by the higher resistivity, typically earthen grounding, return path has a smaller impact. Importantly, it is for safety code reasons only that the neutral/return of the apparatus of the present disclosure would be connected to an earthen "ground" at all. Operationally, it is desirable to implement a floating neutral on the entire medium voltage circuit, from the substation through the adaptor (i.e., 2-phase transformer apparatus 100), along the branch lines to the SDT at the load site, and then (at the secondary of the SDT) ground the return of the load panels only. According to the present disclosure there is no human safety issue to leaving a pole mounted DCA completely isolated from ground. The pole is wood and the DCA's housing is resin. Instead, supplement (human) safety shielding elements to configure this floating neutral design to comply with local code. And, to address the transient condition of a lightning strike each DCA site could be protected by a separate grounding system that shields the power distribution circuit.

Figure 5:
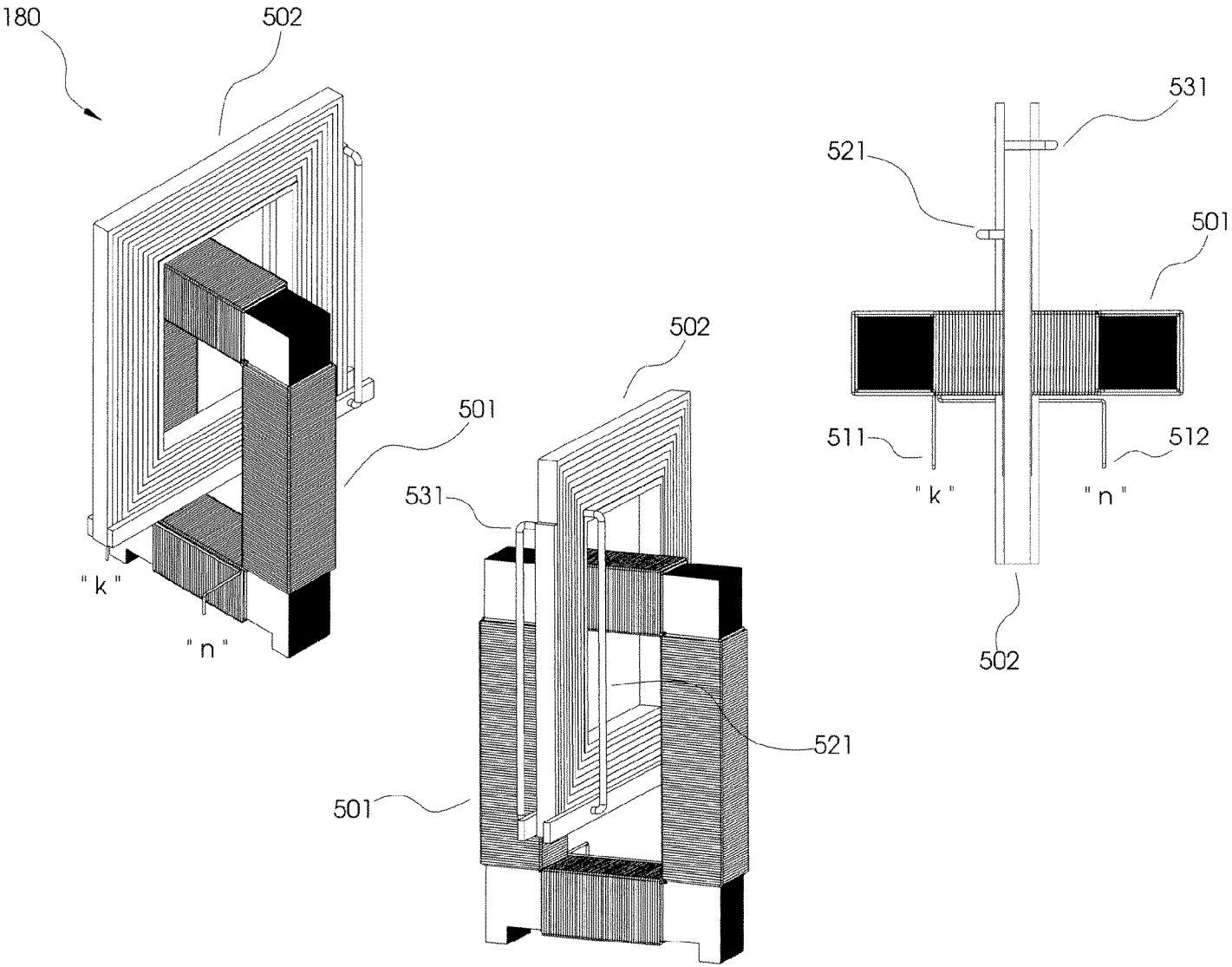
FIG. 5 is front and rear isometric views of the current transformer subassembly enlarged so that all of its elements are visible. Adjacent these isometric illustrations is a top view of the CT in which the relative position of the primary coil set is visible, defining the electrical series connection that it makes between the end points of said coil set.

Referring now to FIG. 5, there is shown the current transformer subassembly CT 180, previously partially described in relation to FIGS. 1 and 3. Like many such instrument transformers, CT 180 may be constructed by passing a primary winding having X turns 502 (insulated conductive band) through a well-insulated toroidal core wrapped with many turns of wire 501. CT primary 502 also acts as the pass-through conductor between primary coils 121 and 131 with which CT 180 is installed in series. In the front facing isometric image on the left of FIG. 5, coil 501's end connections (designated "k" and "n") are visible and for the purposes of this description have been labeled 511 and 512 respectively. In the center image the back side of CT 180 is illustrated, in order to disclose bridge conductors 521 and 531 that are at opposing ends of and electrically by primary 502. At the lower end of conductor 521 is a conductive bar that mates to electrically communicate with connector 321 at the lower end of primary coil 121. Similarly, at the lower end of conductor 531 is a conductive bar that mates to electrically communicate with connector 331 at the lower end of primary coil 131. This circuit from 321 to 521 through 502 to 531 to 331 places CT primary 502 in series with the primary coils of apparatus 100.

Accordingly, the instrumentation core and coil 501 combination is EM induced as a result of current flowing alternately between primary coils 121 and 131 through CT primary 502. CT 180 is thus a series connected instrument transformer, designed to present negligible load to the supply being measured and has an accurate current ratio and phase relationship to enable accurate metering via coil 501's end connections 511 ("k") and 512 ("n") accessible via Terminal Board 190.

Figure 6A:
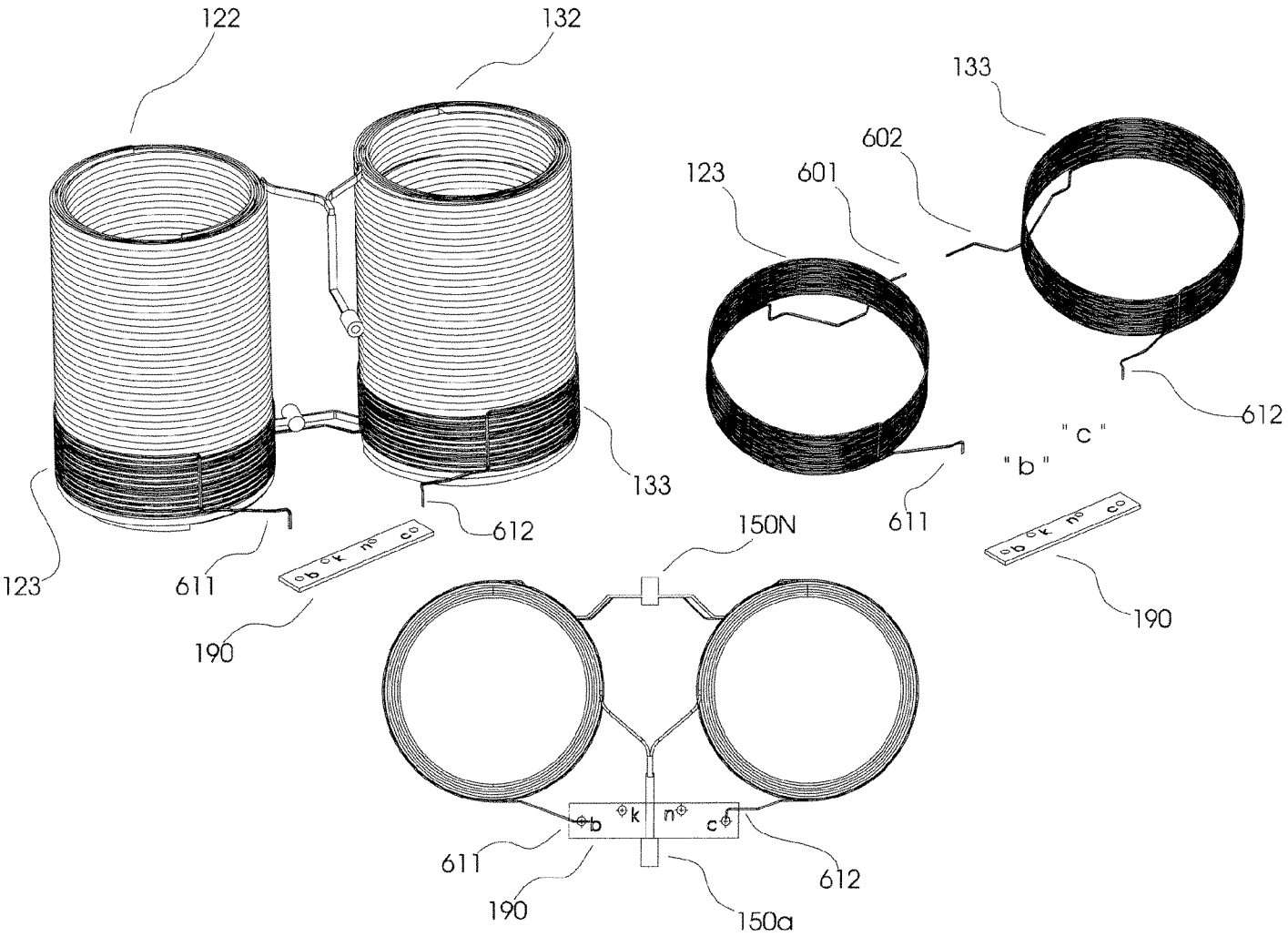
FIG. 6A is an isometric view of the voltage transformer (VT) subassembly enlarged so that all of its elements are visible. Adjacent the isometric illustration is: 1) a top view of the same coil set in position concentrically over a portion of the lower end of the secondary coil set in which the number of layers of each coil set is visible; and 2) an isometric view of the VT coil set over the top of the exterior of the secondary coil set, drawn to scale so that the position and coverage of the VT coils relative to the secondary coils is visible.

Referring now to FIG. 6A, there is shown secondary coils 122 and 132, with previously partially described instrumentation coils 123 and 133 (forming VT 185) in position around a portion of the lower end of (respectively) secondary coils 122 and 132 . . . as well as separate from those coils in order to make the ends of and connections between instrumentation coils 123 and 133 more visible.

Voltage transformer VT 185 (also sometimes called a potential transformer) is a parallel connected type of instrument transformer, which is designed to present negligible load to the supply being measured and have an accurate voltage ratio and phase relationship to enable accurate metering via VT 185's end connections 611 ("b") and 612 ("c") accessible via Terminal Board 190. To achieve this parallel connection, instrumentation coil 123's opposing end 601 is connected to Neutral 150N as is instrumentation coil 133's opposing end 602.

Apparatus 100 is also known as a medium voltage regulating and optimizing terminal (MVROT), which it will sometimes hereafter be referenced. The integrated instrumentation makes it possible to both power additional devices (e.g. metering, recording, communicating) and monitor energy flow through apparatus 100, via Terminal Board 190.

Advantageously, the integrated onboard instrumentation of apparatus 100 permits network Operators to measure voltage, current, energy, peak load, and load profiles on any temporal cycle that they require. Continuous voltage readings are available to operators across terminals "b-c" and continuous current readings are available to operators across terminals "k-n". Energy transfer through apparatus 100 is thus simply determined by multiplying these readings across the time period of interest. Consequently, by continuously recording and processing the output of each the integrated instrumentation transformers of any MVROT the operators can easily generate loading profiles for the distribution branch supplied through it. The loading profiles will include the temporal peak load, which information may be used to manually or automatically manage the subject branch.

In addition to VT 185 terminals b-c presenting continuous access to a record of the MVROT's output voltage, those same terminals may be used to supply power to peripherals, such as the high-impedance low-voltage metering and recording devices used to generate and process those records. Such records are available to a feedback loop that makes the automated control of substation regulators more efficient by having data available in smaller more frequent samples based on which to incrementally manage the voltage regulation process and adjust as needed within a shorter time frame. This leads in turn to smaller swings in network voltage level and the substantial elimination of spikes caused in part by traditional coarse adjustment of voltage to each branch from the substation.

Similarly, with each MVROT (having its own unit ID or signature) also equipped with (optionally solar powered) GPS technology, the system of the present disclosure has the capability of locating the source of faults. The above identified continuous monitoring of energy flow through each MVROT facilitates the rapid identification of fault events in the downstream system, which makes it possible to intervene more quickly and isolate damaged branches of the network. The integrated instrumentation of the MVROT design accordingly enables operators to immediately determine where to send the intervention resources required. Fault events typically comprise either a short circuit (current surge) or an open circuit (current termination) or some sequence of the two. The MVROT peripherals employed in response to such events may transmit (by any suitable wired/wireless communication) an alert to the network operators making them aware of fault conditions. Each MVROT site may communicate with each SDT site that it supplies. The same hardware used to monitor loading balance conditions for billing purposes may quickly both characterize the nature of the fault event and identify the load site where it occurred, in this case for fault intervention purposes. Similarly, the same circuit that energizes the trip coil in a network protection relay would be used to transmit a signal (e.g. PCM impressed on the 60 Hz power supply input lines used as a carrier) back to the supplying MVROT where the SDT site ID data would be included in transmissions to the Operators. The MVROT fault detection system can operate independently through a local series of codes or in cooperation with a broader system, such as GPS, the choice of which mode is selected by Operators based on local infrastructure available.

Advantageously, due in part to the more refined voltage regulation process made possible by the MVROT's onboard instrumentation, the most common faults, suffered by distribution networks in normal operating conditions, are also reduced in frequency. As compared to traditional (large swing) manual regulation processes for adjusting voltage supply at substations, the automated control of voltage regulators inside substations is superior. Importantly, while any automated control means is also superior to manual means, the MVROT's hard-wired solution is hardware based and software compatible. This novel hardware solution is more reliable and its response time is lower. And, even for the more sophisticated management made possible by existing SCADA based systems, the MVROT's hard wired design is fully compatible to supply the data required to use SCADA optimally.

SCADA equipment may be connected to the MVROT as a source of both power and distribution network history and condition data.

Figure 6B:
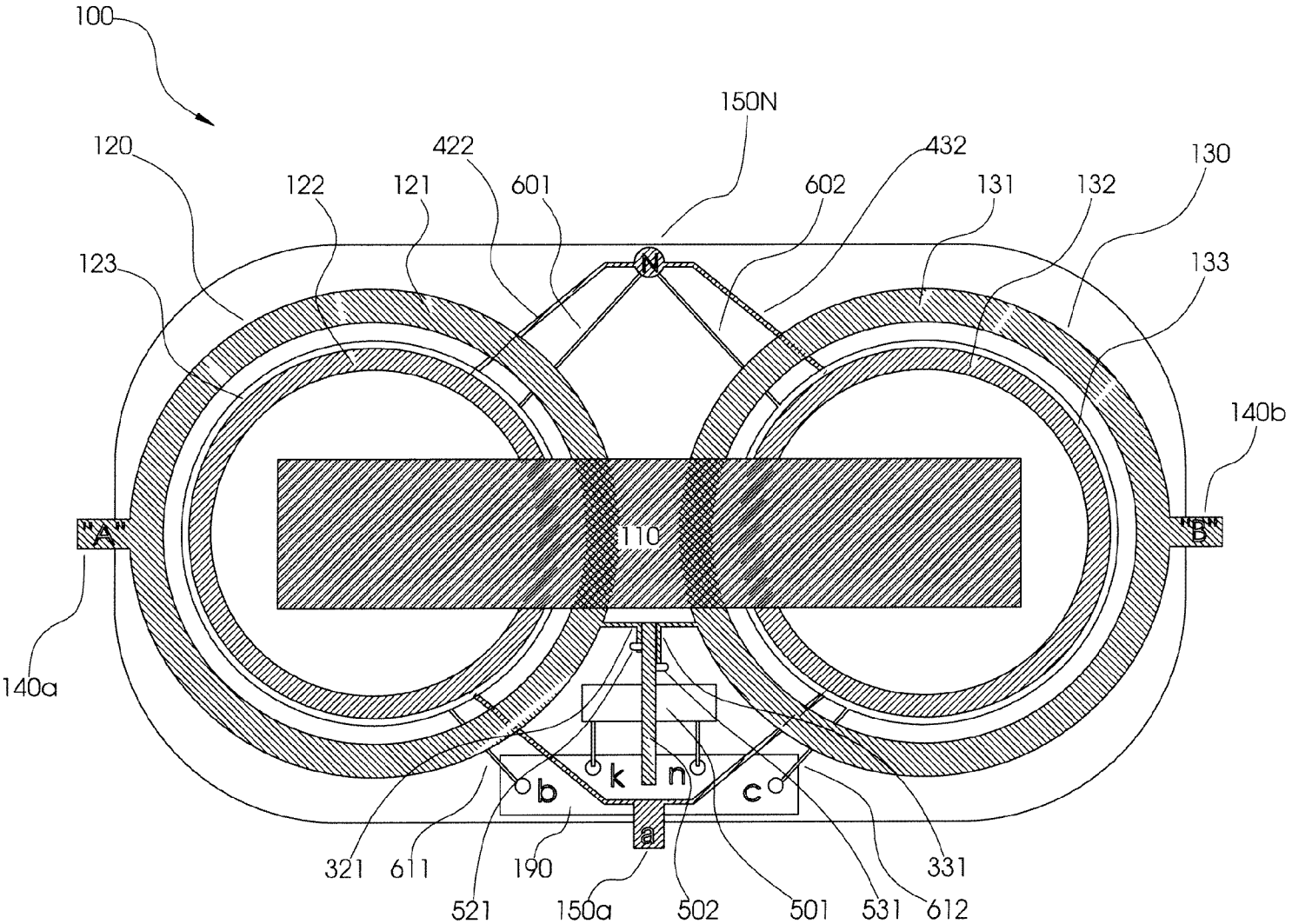
FIG. 6B is a bottom view of coil termination points.

Referring now to FIG. 6B, there is shown a partial x-ray view looking apparatus 100 from the bottom which shows the circuitry of the seven coils in two banks. This view also illustrates that primary coils 121 and 131 are each mechanically isolated from but electromagnetically connected to their secondary coils 122 and 132 respectively. Other elements of apparatus 100 (including core 110) have been included here for ease of cross-reference only.

At the top center of FIG. 6B, output terminal 150N is visible where opposing ends (422, 432, 601 and 602) of four coils meet to close the circuits between secondary coils 122 and 132 as well as instrumentation (VT 185) coils 123 and 133. As previously explained, this is designed to be operated as a floating neutral, but it can be operated (less efficiently) as a grounded neutral.

Similarly, at the bottom center of FIG. 6B, output terminal 150*a* is visible accurately indicating its horizontal location relative to Terminal Board 190, but in a different plane, vertically. The previously described CT 180 connections labeled 511 ("k") and 512 ("n") are most visible here. Similarly, VT 185 connections 611 ("b") and 612 ("c") are also visible in relation to Terminal Board 190.

Figure 7:
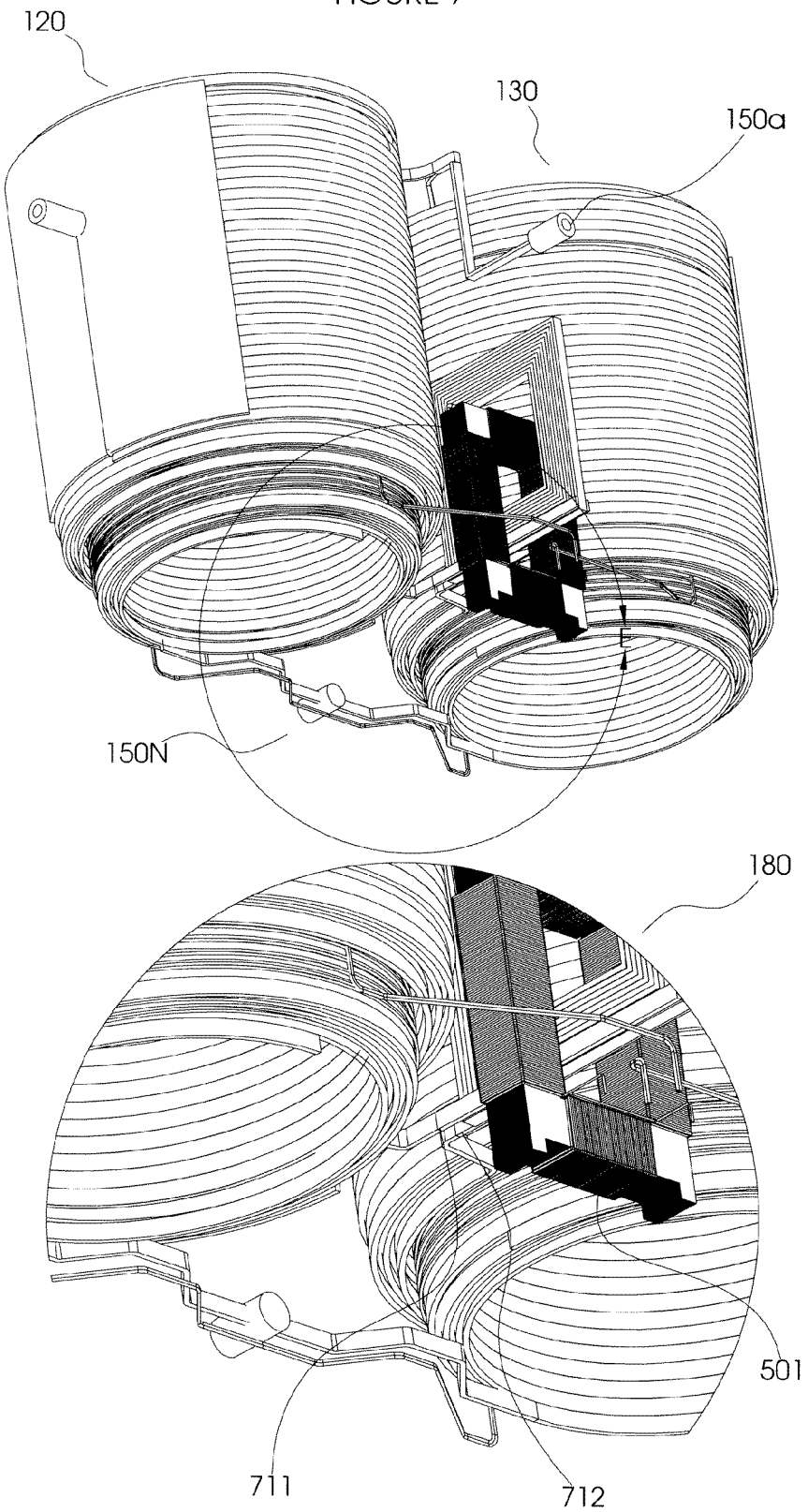
FIG. 7 is an isometric view of the fully nested banks of secondary/instrumentation/primary coils installed over the core. Adjacent the isometric illustration is a partially enlarged side view of the same core and coil banks in which the connections at the base of the CT are visible.

Referring now to FIG. 7, there is shown in isometric and expanded views nested coil banks 120 and 130 comprised of the seven coils and related connections described above with reference to FIGS. 3 to 6B inclusive.

Terminals 140*a*, 150*a* and 150N are also visible. Core 110 has been deliberately omitted for clarity. Insulating supports 135 (visible in FIG. 1) are positioned underneath each primary coil to ensure correct spacing between the bottoms (visible in FIG. 7) of the (longer) secondary (e.g. 122) and outer primary (e.g. 121) coils in each concentric coil pair.

Also visible in FIG. 7 are fabrication arms 711 and 712 that hold CT primary 502 in position (floating inside core and coil 501) until the resin (e.g., Araldite®) is poured to permanently hold it. With these fabrication arms 711 and 712 in place, it is possible to electrically connect 321 to 521 and 331 to 531, before immersion in resin.

According to at least some of the implementations illustrated and described herein, apparatus 100 ("MVROT") is in summary a 250 KVA (example only) 2-phase power transformer with two integrated instrument transformers, namely a parallel connected set of instrument coils over the secondary forming a Voltage transformer and a Current transformer connected in series with the primary coils.

Figure 8:
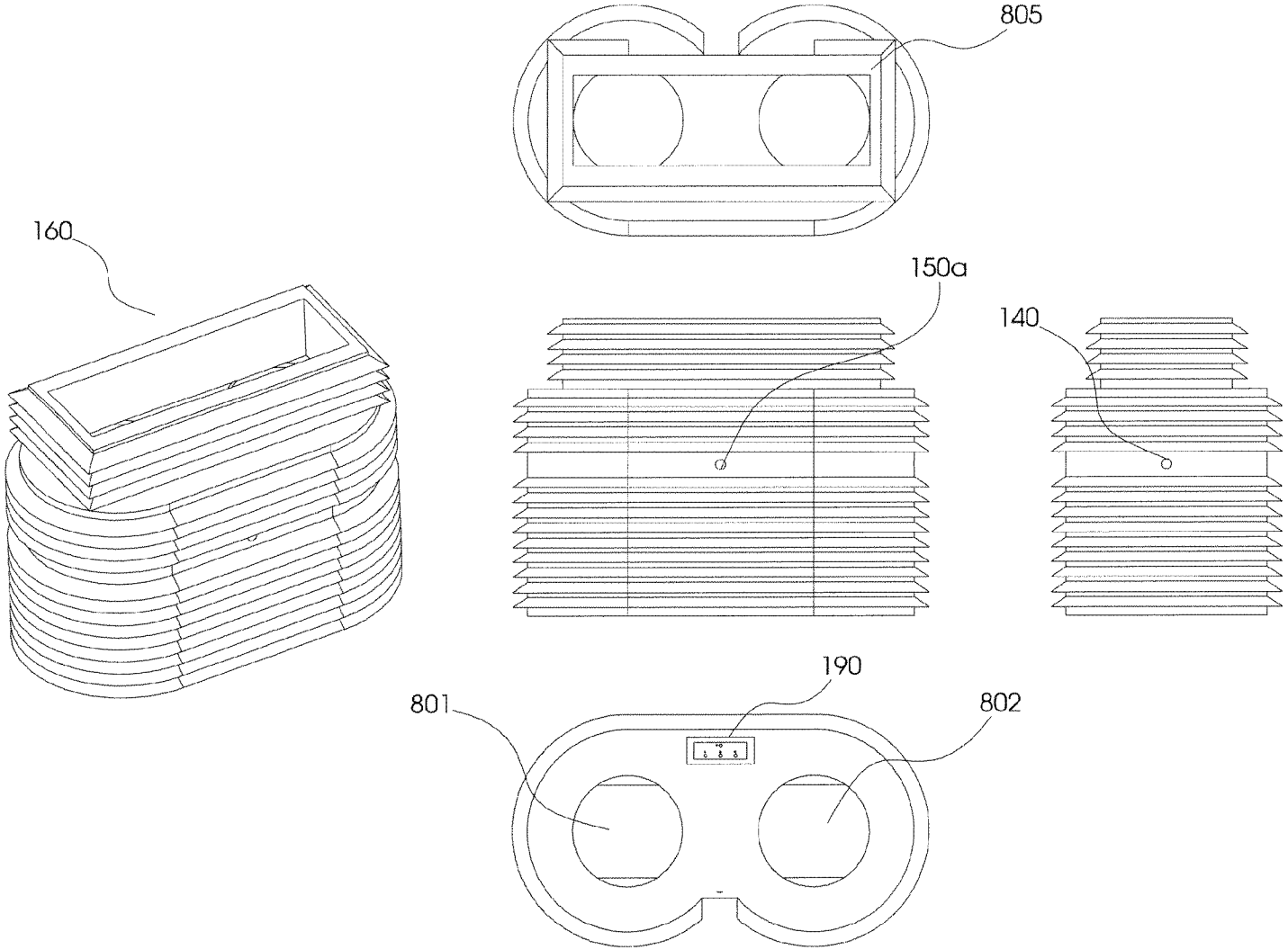
FIG. 8 is an isometric view of the cast encasement. Adjacent this isometric illustration are three plan views of the encasement.

Referring now to FIG. 8, there is shown cast encasement 160 in several views including different angles from which it is viewed. Encasement 160 (typically cast in quartz impregnated Araldite® or other suitable composition) is molded with heat dissipating fins 810 (also known as "sheds") cast into the exterior of its body. The relative size and shape of encasement 160 and each of its fins is a design factor that is again influenced by the power transfer and thermal requirements set by the specified installation's capacity, ambient conditions and other requirements, which it is understood will vary with the average energy transfer and casting composition, etc. Since a greater mass of the encasement 160 tends to provide a longer thermal time constant with solid cast coils, and better protection against short term overloads, it is to be understood that the variants of this present disclosure will tend to be physically larger as their electrical capacity increases.

In the top view shown at the top of FIG. 8, top opening 805 is visible in which the partially assembled core 110 is placed during construction. In the bottom view shown at the bottom of FIG. 8, passages 801 and 802 are visible through which core legs 111 and 112 will be guided in preparation for final assembly of core 110. Also visible in this bottom view is Terminal Board 190 recessed into the base of encasement 160. That recess is not plainly visible in this figure. Above the bottom view, there is shown a side view of the "front" of apparatus 100 in which output connector 150*a* is visible and into which network connector 146 may be threaded. Finally, to the right of this side view, there is shown an end view in which an input connector 140 (representative of 140*a* and 140*b*) is seen.

As illustrated, apparatus 100 is weather proof and suitable for pole installation. However, with any suitable human safety enclosure it is to be understood that transformer 100 can be installed at ground level to adapt underground portions of a typical power distribution network.

In the annulus between vertical core legs 111 and 112 and coil banks 120 and 130 there is sufficient space that transformer 100 can radiatively cool passively in suitable installation locations (e.g. Canada), however in equatorial installation locations (e.g. Mexico) the specified implementation of transformer 100 may include active means to force air through the residual coil bank annulus, to convectively enhance transformer 100's cooling capacity.

Figure 9:
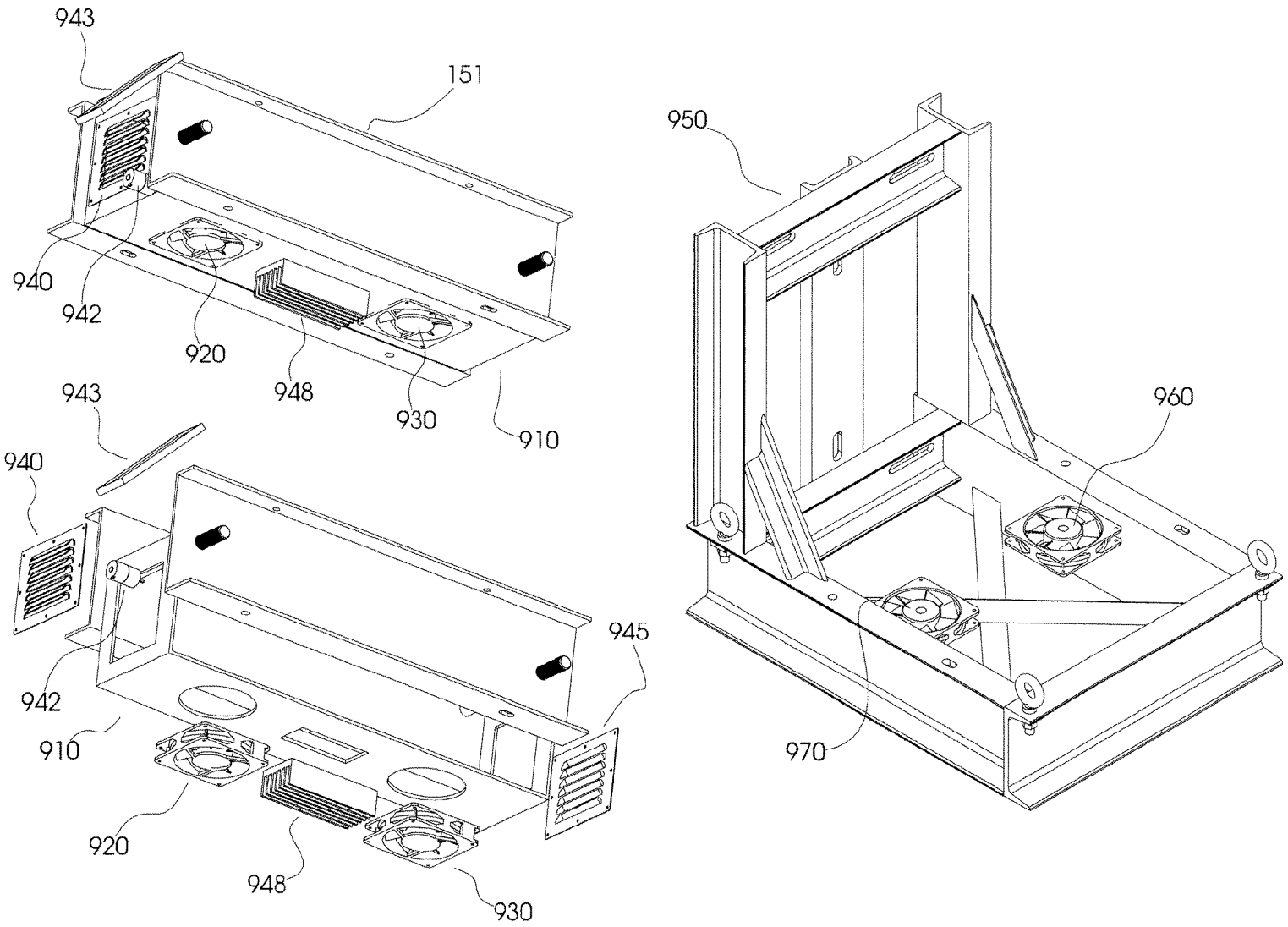
FIG. 9 is an isometric view of one implementation of a temperature management (i.e. coil cooling) subassembly. Adjacent this isometric illustration are three plan views of that cooling and ventilation accessory.

Referring now to FIG. 9, there is shown Temperature Management Subsystem ("TMS") 910, in three views disclosing implementations optimized for installation in alternate positions relative to apparatus 100. According to one implementation TMS 910 may be installed directly into the base of apparatus 100 between core clamps 151 (FIGS. 1 and 2). Provision is made for shutter vents 940 (actuating motors 942) to permit ambient air drawn through its ends and reversible forced-air means (e.g. turbines, fans or vacuums) 920 and 930 to cause air to be drawn through the annulus between the interior of secondary coils (122 and 132) and the exterior of core legs (111 and 112) to either cool or warm apparatus 100. TMS 910 is configurable for installation at the base of each MVROT and may be installed: integrated with base plates 151; under base plates 151 (i.e., between them and mounting bracket 950); or on separate bracket adjacent the mounting bracket 950 on which the MVROT is supported.

Many alternate variations may be implemented. For example, supplementary heat sinks 945 may be added to increase the radiative surface area available. At the same time (as seen to the right of TMS 910), multiple cooling mechanisms may be implemented by adding supplementary forced air means 960 and 970 to pole mounting bracket 950 causing additional air to be forced over the exterior of encasement 160, thereby enhancing convection over heat dissipating fins 810 (FIG. 8) via which waste heat conducted from the interior of encasement 160 is removed by convective means and dissipated or "shed" by radiation and convection from "rib like" (by way of example only) fins 810.

In summary, but by reference to all of the forgoing figures, the (e.g., solar powered) coil-cooling aspect of TMS 910 (for use especially in hot sunny weather environments) is a by-product of the same design based on which the core can be so removed from the casting containing damaged coil banks. After the pre-assembled coil banks 120 and 130 (i.e., including their instrumentation coil sets) are installed in the mold and immersed in resin (e.g., Araldite®) cured to ensure no movement between the primary and secondary coil sets during operation, the partially pre-assembled core 110 is installed through the top 805 of the cast housing 160, which is then inverted to install the bottom core bridge 113 and other base elements by which the core subassembly 110 is securely fixed relative to the coil banks through which it guides magnetic flux. By inserting core legs 111 and 112 after coil banks 120 and 130 have been preassembled and then cast in resin, these legs remain separate and removable from casting 160, and there remains an annulus between the interior of each coil bank and the exterior of each core leg assembly. That annulus enables air to flow in at the base of the MVROT 100 and upward over each phase via which excess heat is convectively expelled from the MVROT interior. Heat generated by the coil banks conducts its way radially across the quartz impregnated Araldite® to the interior, while simultaneously radiating from the large surface area fins 810 on the exterior of apparatus 100. Air currents being forced or drawn up the annulus are in addition to the natural upward movement of heat escaping via weather shield 170 on top of apparatus 100.

Managing the temperature of the coils of dry type transformers is important to their performance and life cycle, and waste heat is difficult to eliminate. Advantageously, the design of the present disclosure is greater than 99 percent electrically efficient such that only a very small amount of heat is ever generated, by comparison to competing 2-phase transformers. This makes the MVROT well-suited to operation in hot weather conditions such as Arizona. Conversely, the MVROT's waste heat may actually need to be stored in very cold operating conditions such as Alaska and the Arctic. Accordingly, TMS 910 contemplates both high and low ambient temperatures. For example, in extreme heat ambient conditions (whether due to location or season), TMS 910 may include forced air means for directing air over the exterior sheds as well as up each annulus and through any supplementary channels in encasement 160. Moreover, TMS 910 could include other cooling means to enhance the rate of cooling during peak thermal conditions. Retractable awning and other means for providing shade to the transformer body may be provided in addition to vent openings, variable fan speed and all other elements designed to manage the coil temperature—all controlled by TMS 910.

In at least some implementations, TMS 910 may be powered at least partially (e.g., primarily) by its own solar cells 943 with access to network power at VT 185 terminals b-c as needed. The control circuitry of TMS 910 may include flash memory respecting a thermal profile for the specific MVROT geographical installation. Thermocouples or other suitable means of determining actual coil and ambient thermal conditions may supply samples of data based on which the onboard routines can evaluate the need to (for example) increase fan speed or close all vents based on expected (based on historical profiles or current forecasts) conditions in the near future. By continuously monitoring exterior and interior temperatures around and of the MVROT, TMS 910 is able to maintain coil banks 120 and 130 near their optimal operating thermal range, thereby also operating at their optimal electrical efficiency to help maintain the delivery of clean power to their branch of the power distribution network in which they are installed.

Advantageously, the inventive system and manner in which this novel transformer apparatus 100 is installed results in a smaller voltage drop and lower current flowing through its distribution network between the substation on its primary side and the group of SDTs that this device supplies. The higher secondary voltage and lower current in the transmission lines results in less electrical waste in the network and less thermal waste needing to be dissipated by the coil banks. In addition to the smaller quantum of waste heat generated by the implementations of the present disclosure, the implementations have a higher overall thermal capacity for self-cooling than comparable (electrical capacity) 2 phase transformers. The quartz filler used in the Araldite® encasement makes the resin more thermally conductive than ordinary dry transformers, which facilitates excess heat from the coil banks being transmitted across the encasement body 160 to the sheds on its exterior surface, from which larger surface area sheds the radiative transfer of heat to the ambient atmosphere also takes place. Depending on the location (relative to the equator and sea level), whenever needed the present disclosure also employs convective means of dissipating excess heat. Sensors connected to TMS 910 monitor its body temperature and ambient weather conditions based on which cooling fan speed can be increased or switched off as needed. Wind speed and directional sensors mounted on the exterior housing feed data to the MVROT's integrated cooling system, which is adjusted according to current demand (i.e. heat that may need to be dissipated at one time of day and stored at a different time of day. In hot dry climates the MVROT will open all of it (upper and lower) vents to maximize air flow to be exhausted out weather shield 170 (FIG. 1) at the top. To minimize heating in sunny climates the cooling fans may be driven by solar cells rather than drawing on its network.

Similarly, in cold moist climates TMS 910 may close all of its vents to minimize air flow, whenever it is appropriate to retain its heat through long arctic nights. This integrated thermal management system, like its integrated instrumentation subsystem gives the MVROT a massive advantage in maintaining optimal operational conditions both electrically and thermally, thereby extending its life cycle of highly reliable performance and clean power.

According to all of the foregoing, distribution network owners can deliver, and charge load site consumers for a greater portion of the total energy generated by and transmitted across existing infrastructure. Inserting one or more distribution circuit adaptors as a novel subsystem of conventional distribution network reduces losses and extends the life cycle of existing lower capacity branch conductors, while resulting in more symmetrical loading of the trunk lines also tends to extend the life cycle of the source generators. The concurrent reduction of spikes and surges may also permit operators to collect a premium for delivering "cleaner" power.

Additionally, in the case of damage or failure to a component (e.g., coils) of the transformer apparatus, the core may be reused. For example, at least one of the top core bridge or bottom core bridge may be decoupled from the core legs. Then, the core legs may be removed from the original encasement which includes the damaged component(s). The core legs may be inserted into passages of a new encasement which is to be used with the core. Finally, the at least one of the top core bridge or bottom core bridge which was decoupled from the core legs may be coupled again to the core legs to form the new transformer apparatus with the new encasement. Whether one or both of the core bridges needs to be removed to replace the encasement may depend on the particular installation location and/or capabilities of the entity servicing the transformer apparatus.

Additional service possible to achieve with this design is to implement a dry type single phase step down transformer. In such implementations, primary coils may be around one leg (e.g., leg 111) of the magnetic core 110, and secondary coils around the other leg (e.g., leg 112). Such implementations of the present disclosure may easily be adopted to replace liquid type step down transformers (SDT) installed on the poles.

The foregoing detailed description has set forth various implementations of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. Those of skill in the art will recognize that many of the methods or algorithms set out herein may employ additional acts, may omit some acts, and/or may execute acts in a different order than specified.

The various implementations described above can be combined to provide further implementations. To the extent that they are not inconsistent with the specific teachings and definitions herein, all of the U.S. patents, U.S. patent application publications, U.S. patent applications, foreign patents, foreign patent applications and non-patent publications referred to in this specification, including U.S. Provisional Patent Application Ser. No. 62/274,948, filed Jan. 5, 2016 and U.S. Provisional Patent Application Ser. No. 62/395,539, filed Sep. 16, 2016, are incorporated herein by reference, in their entirety. Aspects of the implementations can be modified, if necessary, to employ systems, circuits and concepts of the various patents, applications and publications to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A transformer apparatus, comprising:

an encasement having first and second passages therein spaced apart from each other, each of the first and second passages extends between a top and a bottom of the encasement;

first and second coil banks disposed within the encasement, each of the first and second coil banks surrounds a respective one of the first and second passages, each of the first and second coil banks includes at least one coil;

a core comprising:

a first core leg selectively positionable within the first passage of the encasement, the first core leg includes an upper end and a lower end opposite the upper end;

a second core leg selectively positionable within the second passage of the encasement, the second core leg includes an upper end and a lower end opposite the upper end;

a top core bridge selectively coupleable to each of the respective upper ends of the first and second core legs; and a bottom core bridge selectively coupleable to each of the respective lower ends of the first and second core legs.

2. The transformer apparatus of claim 1 wherein the first coil bank comprises a first primary coil and a first secondary coil, and the second coil bank comprises a second primary coil and a second secondary coil.

3. The transformer apparatus of claim 2 wherein the first secondary coil is disposed concentrically inside the first primary coil, and the second secondary coil is disposed concentrically inside the second primary coil.

4. The transformer apparatus of claim 2 wherein the first and second primary coils are electrically coupled in series, and the first and second secondary coils are electrically coupled in parallel.

5. The transformer apparatus of claim 1, further comprising:

a first screen which at least partially surrounds the first coil bank; and a second screen which at least partially surrounds the second coil bank.

6. The transformer apparatus of claim 5 wherein each of the first screen and the second screen comprise graphite.

7. The transformer apparatus of claim 1 wherein the encasement is formed of a resin.

8. The transformer apparatus of claim 1 wherein the encasement is formed of a resin mixed with a quartz filler.

9. The transformer apparatus of claim 1 wherein each of the first core leg, second core leg, top core bridge and bottom core bridge is comprised of a stack of a plurality of sheets of ferromagnetic material.

10. The transformer apparatus of claim 1 wherein each of the first core leg, second core leg, top core bridge and bottom core bridge is comprised of a stack of a plurality of sheets of laminated grain-oriented silicon steel.

11. The transformer apparatus of claim 1, further comprising:

an upper clamp which selectively couples the top core bridge to each of the respective upper ends of the first and second core legs; and a lower clamp which selectively couples the top core bridge to each of the respective upper ends of the first and second core legs.

12. The transformer apparatus of claim 1, further comprising:

a voltage instrumentation transformer comprising:

a first coil disposed within the first coil bank; and a second coil disposed within the second coil bank.

13. The transformer apparatus of claim 12 wherein the first coil bank comprises a first primary coil and a first secondary coil, the second coil bank comprises a second primary coil and a second secondary coil, the first coil of the voltage instrumentation transformer is disposed concentrically outside the first secondary coil, and the second coil of the voltage instrumentation transformer is disposed concentrically outside the second secondary coil.

14. The transformer apparatus of claim 13 wherein respective first terminals of each of the first coil of the voltage instrumentation transformer, the second coil of the voltage instrumentation transformer, the first secondary coil and the second secondary coil are electrically coupled together.

15. The transformer apparatus of claim 1, further comprising:

a current instrumentation transformer comprising:

a current instrumentation transformer core;

a first coil surrounding at least a portion of the current instrumentation transformer core, the first coil electrically coupled in series with the at least one coil of the first coil bank; and a second coil surrounding at least a portion of the current instrumentation transformer core.

16. The transformer apparatus of claim 15 wherein the first coil bank comprises a first primary coil and a first secondary coil, the second coil bank comprises a second primary coil and a second secondary coil, and the first coil of the current instrument transformer is electrically coupled in series with the first primary coil and the second primary coil.

17. The transformer apparatus of claim 1, further comprising:

a voltage instrumentation transformer electrically coupled in parallel with at least one coil of the transformer apparatus; and a current instrumentation transformer electrically coupled in series with at least one of coil of the transformer apparatus.

18. The transformer apparatus of claim 17 wherein at least one of the voltage instrumentation transformer and the current instrumentation transformer provide power to at least one of a metering device, a recording device or a communication device.

19. The transformer apparatus of claim 17 wherein at least one of the voltage instrumentation transformer and the current instrumentation transformer provide monitoring of at least one of voltage, current, energy, peak load or load profiles.

20. The transformer apparatus of claim 1, further comprising:

a temperature management subsystem which in operation selectively controls air flow through the first and second passages of the encasement.

21. The transformer apparatus of claim 20, further comprising:

at least one instrumentation transformer electrically coupled to at least one coil of the transformer apparatus and which provides operational parameter data relating to at least one operational parameter of the transformer apparatus to the temperature management subsystem, wherein the temperature management subsystem selectively controls air flow through the first and second passages of the encasement based at least in part on the received operational parameter data.

22. The transformer apparatus of claim 20 wherein the temperature management subsystem comprises at least one fan positioned to cause air to flow upward through at least one of the first and second passages of the encasement.

23. The transformer apparatus of claim 1 wherein the first coil bank comprises a first primary coil and a first secondary coil nested concentrically inside the first primary coil, and the second coil bank comprises a second primary coil and a second secondary coil nested concentrically inside the second primary coil, the first and second primary coils are electrically coupled in series, and the first and second secondary coils are electrically coupled in parallel.

24. The transformer apparatus of claim 23, further comprising:

a voltage instrumentation transformer comprising:

a first coil nested concentrically outside the first secondary coil; and a second coil nested concentrically outside the second secondary coil; and a current instrumentation transformer comprising:

a current instrumentation transformer core;

a first coil surrounding at least a portion of the current instrumentation transformer core, the first coil electrically coupled in series with the first primary coil and the second primary coil; and a second coil surrounding at least a portion of the current instrumentation transformer core.

25. The transformer apparatus of claim 23 wherein the first primary coil is electrically coupleable to a first phase terminal of a three-phase power source, the second primary coil is electrically coupleable a second phase terminal of the three-phase power source and each of the first and second secondary coils are electrically coupleable to a load to provide single phase power to the load.

26. The transformer apparatus of claim 1 wherein the first coil bank comprises a primary coil of a single phase step down transformer and the second coil bank comprises a secondary coil of a single phase step down transformer.

27. The transformer apparatus of claim 1 wherein each of the first and second passages of the encasement are at least partially open at the top and bottom of the encasement to provide self-cooling of the transformer apparatus via the chimney effect.

28. The transformer apparatus of claim 1 wherein each of the first and second passages has a respective wall which is cylindrical in shape to reduce or prevent stray flux of the transformer apparatus.

* * * * *